US007755660B2

(12) United States Patent
Nejikovsky et al.

(10) Patent No.: US 7,755,660 B2
(45) Date of Patent: Jul. 13, 2010

(54) VIDEO INSPECTION SYSTEM FOR INSPECTION OF RAIL COMPONENTS AND METHOD THEREOF

(75) Inventors: Boris Nejikovsky, Falls Church, VA (US); Christian Diaz, Falls Church, VA (US); Gary A. Carr, Falls Church, VA (US); Toofan Parniani, Falls Church, VA (US)

(73) Assignee: Ensco, Inc., Falls Church, VA (US)

( * ) Notice: Subject to any disclaimer, the term of this patent is extended or adjusted under 35 U.S.C. 154(b) by 1419 days.

(21) Appl. No.: 10/836,629

(22) Filed: May 3, 2004

(65) Prior Publication Data

US 2004/0263624 A1 Dec. 30, 2004

Related U.S. Application Data

(60) Provisional application No. 60/467,150, filed on May 2, 2003.

(51) Int. Cl.
*H04N 7/12* (2006.01)

(52) U.S. Cl. ..... 348/143; 348/135; 348/148; 348/159

(58) Field of Classification Search ..... 348/143, 348/148, 159, 135
See application file for complete search history.

(56) References Cited

U.S. PATENT DOCUMENTS 1,601,080 A 9/1926 Otis
3,562,419 A 2/1971 Stewart et al.
4,915,504 A 4/1990 Thurston
5,636,026 A * 6/1997 Mian et al. ..... 356/602
6,064,428 A 5/2000 Trosino et al.
6,356,299 B1 3/2002 Trosino et al.
6,532,038 B1 3/2003 Haring et al.
6,594,591 B2 * 7/2003 Clark et al. ..... 702/35
6,600,999 B2 * 7/2003 Clark et al. ..... 702/35

FOREIGN PATENT DOCUMENTS

WO WO 2006/004846 A2 12/2006

* cited by examiner

*Primary Examiner*—Andy S. Rao
*Assistant Examiner*—Geepy Pe
(74) *Attorney, Agent, or Firm*—Nixon Peabody LLP; Jeffrey L. Costellia

(57) ABSTRACT

A video inspection system and method for facilitating inspection of a rail component while traveling on the railroad track. The system includes a light source that provides illumination to a rail of the railroad track, a triggering device for automatically providing a trigger signal, a camera adapted to provide an image of the illuminated rail component, and a computing device adapted to capture the image provided by the camera based on the trigger signal. A method for inspecting rail components is also provided, the method including the steps of illuminating a rail of the railroad track, automatically providing a trigger signal, providing a camera adapted to provide an image of the rail component, and capturing the image of the rail component that is provided by the camera based on the trigger signal.

55 Claims, 5 Drawing Sheets

VIDEO INSPECTION SYSTEM FOR INSPECTION OF RAIL COMPONENTS AND METHOD THEREOF

This application claims priority to U.S. Provisional Application No. 60/467,150, filed May 2, 2003, the contents of which are incorporated herein by reference.

BACKGROUND

1. Field of the Invention

The present invention is directed to a system for inspecting rail components of a railroad track, and a method for inspecting such rail components.

2. Description of Related Art

Maintaining proper conditions of rail components of a railroad track is of paramount importance in the railroad transportation industry. Rail components include joint bars, fasteners, switch frogs, rail fasteners, etc. as well as the rail segments themselves which form the railroad track. Conditions of the railroad track greatly impacts safety and reliability of rail transportation. Failure or degradation of various rail components of a railroad track can cause derailment of the train traveling on the railroad track. Such derailment can cause significant property damage, and injury to passengers and crew aboard the derailed train, as well as to bystanders.

In the above regard, joint bars have been identified as a critical rail component that is a major cause of railroad derailment. Joint bars are metal connectors that are secured to the sides of two adjacent rails of the railroad track to thereby secure the two rails at their juncture. The joint bars typically include a plurality of through holes which align with corresponding through holes provided on the webs of the rails. Fasteners are generally used to secure the joint bars to the rails, thereby securing the adjacent rails to each other, end to end. Thus, the joint bars act to stabilize and secure the juncture where the two rails meet, and ensure that the two rails do not move transversely and become misaligned with respect to each other as the wheels of the railcar travel from one rail, and on to the other rail.

To monitor the condition of the railroad track and to ensure that joint bars are in good condition, joint bars are presently inspected visually. This visual inspection is performed by trained railroad maintenance personnel, such as an inspector, during track inspection when other components of the railroad track are also inspected. However, the quality of the visual inspection is generally poor, especially when the visual inspection is performed from a hi-railer which is a vehicle that has been modified to drive on railroad tracks. Such hi-railers are often used by an inspector to travel on the railroad track while simultaneously inspecting the railroad track.

The limitation of this prior art method of inspecting railroad components is that it is very difficult for the inspector to see the small defects or damage in the railroad components while driving the hi-railer. This limitation is especially exacerbated by the fact that defects or damage to joint bars are especially difficult to see since the joint bars are secured to the sides of the rails, and joint bars can fail due to cracks that are about one millimeter in width. Of course, inspection that is performed on foot can provide better results since the inspector can carefully inspect each of the joint bars, and other rail components, more closely. However, such inspection performed on foot is a very slow and tedious process requiring many hours to inspect several miles of railroad track.

U.S. Pat. No. 6,356,299 to Trosino et al. discloses an automated track inspection vehicle for inspecting a railroad track for various anomalies. The automated track inspection vehicle disclosed includes a self-propelled car equipped with cameras for creating images of the track. This reference discloses that a driver and an inspector visually inspect the track and right-of-way through a window in the vehicle, thereby identifying anomalies such as presence of weeds, blocked drain, improper ballast, missing clip, or defective tie. The reference further discloses that the images from the cameras ate viewed by the inspector on a video terminal to detect anomalies on the railroad track. When anomalies are detected by the driver or the inspector, a signal is provided to store the video data for review by an analyst. The reference notes that the analyst reviews the stored video data to confirm the presence of an anomaly, and generates a track inspection report identifying the type and location of the anomaly, as well as the required remedial action.

The significant limitation of the inspection vehicle disclosed in Trosino et al. and the method taught therein is that it requires the inspector to continually perform visual inspection of the railroad track while traveling on the railroad track, such inspection being not much better in quality as compared to the conventional inspection method from a hi-railer noted above. The method taught also requires three trained individuals at the same time. In addition, the disclosed inspection vehicle requires the inspector to press an appropriate button indicating the type of anomaly identified, in order for the vehicle to capture, and store, the images of the railroad track for review by the analyst.

If the inspector does not see the anomaly and/or push the appropriate button, an image that can be reviewed by the analyst is not captured. This is especially problematic if the damage and/or defect to the railroad track is very small and difficult for the inspector to see. For example, as noted above, many derailment accidents are attributable to damage or failure of joint bars. Due to the positioning of the joint bars adjacent to the web of the rail, surface cracks on the joint bars would be extremely difficult to see by the inspector utilizing the inspection vehicle described in Trosino et al. Therefore, whereas the railcar vehicle of Trosino et al. is appropriate for inspecting a railroad track for large anomalies which are easily visible to the inspector, such as the presence of weeds, blocked drain, etc., the described inspection vehicle does not allow facilitated inspection of smaller rail components, or smaller defects associated thereto. The reference further discloses that the inspection vehicle allows inspection of a railroad track at speeds of 30-50 miles per hour.

Therefore, in view of the above, there exists an unfulfilled need for a system for inspecting rail components of a railroad track, and a method thereof. In particular, there exists an unfulfilled need for such a system and method that allows accurate and efficient, inspection of rail components, even for very small defects or damage, with reduced time and effort.

SUMMARY OF THE INVENTION

In view of the above, one aspect of the present invention is a system for inspecting rail components, such as joint bars, switch frogs, rail fasteners, and switch points of a railroad track, and a method thereof.

Another aspect of the present invention is in providing such a system and method that allows accurate and efficient inspection of rail components.

Yet another aspect of the present invention is in providing such a system and method that allows inspection of rail components with reduced time and effort.

Still another aspect of the present invention is in providing such a system and method that allows inspection of rail components while traveling on the railroad track.

In accordance with one aspect of the present invention, a video inspection system that is mountable on a railcar, or a vehicle adapted to travel on a railroad track, is provided. The video inspection system is adapted to facilitate inspection of a rail component while traveling on the railroad track. In one embodiment, the video inspection system includes a light source that provides illumination to a rail of the railroad track, a sensor adapted to provide an output signal, a camera adapted to provide an image of the illuminated rail component, and a computing device adapted to capture the image provided by the camera based on the output signal from the sensor.

In accordance with one embodiment of the present invention, the video inspection system further includes a trigger generator for converting the output signal from the sensor to a trigger signal, and the computing device further includes an interface device that captures the image provided by the camera based on the trigger signal. In accordance with another embodiment of the present invention, the video inspection system further includes an encoder that provides pulse signals corresponding to speed of the vehicle or railcar, and the computing device includes a counter/timer device that allows capturing of constant resolution images from the camera, independent of speed of the vehicle or railcar.

In still another embodiment of the present invention, the video inspection system further includes a positioning means for determining the position of the railcar or the vehicle, and for providing position data indicative of the determined position. The computing device may be further adapted to correlate the captured image of the rail component with the position data to allow determination of the location at which the image was captured. In this regard, the positioning means may be implemented with a GPS receiver.

In one implementation of the video inspection system, the sensor is a laser based distance sensor, and the output signal from the sensor is indicative of the presence of the rail component. The distance sensor may be positioned above, and pointed towards, the rail of the railroad track. In another implementation, the sensor is a vibration sensor, and the output signal from the sensor is indicative of vibration caused by the rail of the railroad track as the railcar or vehicle travels thereon. In such an implementation, the vibration sensor may be one or more accelerometers secured to a frame member of the railcar or vehicle.

In various embodiments of the present invention, the camera of the video inspection system may be a line scan camera, a time delay integration line scan camera, or an area scan camera. Depending on the type of camera used, the light source may provide continuous illumination, or be implemented as a strobe light that provides flash illumination.

Furthermore, in accordance with another embodiment, the computing device may be provided with a digital image processing software for analyzing the captured images. In one embodiment, the digital image processing software includes a pattern recognition software for identifying presence of a defect or damage to the rail component. An optical character recognition software may also be provided for recognizing inscriptions on the rail component.

In accordance with another embodiment of the present invention, the video inspection system includes a light source that provides illumination to a rail of the railroad track, a triggering means for automatically providing a trigger signal, a camera adapted to provide an image of the illuminated rail component, and a computing device adapted to capture the image provided by the camera based on the trigger signal.

In one embodiment, the video inspection system further includes a distance sensor that provides an output signal indicative of the presence of the rail component, the trigger signal being provided by the triggering means based on the output signal. In another embodiment, the video inspection further includes a vibration sensor that provides an output signal indicative of vibration caused by the rail of the railroad track as the railcar or vehicle travels thereon, the trigger signal being provided by the triggering means based on the output signal.

In still another embodiment, the computing device includes a digital image processing software for analyzing the captured images. In this regard, the digital image processing software includes a pattern recognition software for identifying presence of a defect or damage to the rail component. In one embodiment, the trigger signal is provided by the triggering means based on whether the digital image processing software identifies presence of a defect or damage to the rail component. Optionally, the digital image processing software may also include an optical character recognition software for recognizing inscriptions on the rail component.

In accordance with another aspect of the present invention, a method for inspecting rail components of a railroad track while traveling on the railroad track is provided. The method includes the steps of illuminating a rail of the railroad track, electronically detecting the presence of a rail component, providing an output signal indicating presence of the rail component, providing a camera adapted to provide an image of the rail component, and capturing the image of the rail component that is provided by the camera based on the output signal. The method may also include the steps of determining the position at which the image was captured, and correlating the captured image of the rail component with the determined position.

In accordance with another embodiment, the method for inspecting rail components includes the steps of illuminating a rail of the railroad track, electronically detecting vibration caused by the rail of the railroad track while traveling thereon, providing an output signal indicating atypical or abnormal vibration, providing a camera adapted to provide an image of a rail component, and capturing the image of the rail component that is provided by the camera based on the output signal. The method may also include the steps of determining the position at which the image was captured, and correlating the captured image of the rail component with the determined position.

In still another embodiment of the present invention, the method for inspecting rail components includes the steps of illuminating a rail of the railroad track, automatically providing a trigger signal, providing a camera adapted to provide an image of the rail component, and capturing the image of the rail component that is provided by the camera based on the trigger signal.

In one embodiment, the method further includes the step of electronically detecting the presence of the rail component, wherein the trigger signal is automatically provided when the rail component is detected. In another embodiment, the method further includes the step of electronically detecting vibration caused by the rail of the railroad track while traveling thereon, the trigger signal being automatically provided when an atypical or abnormal vibration is detected.

In yet another embodiment, the method further includes the step of digitally processing the captured image to identify at least one of defect and damage to the rail component. In this regard, the trigger signal may be automatically provided upon identification of a defect or damage to the rail component. Optionally, the method may further include the step of electronically recognizing inscriptions on the rail component.

These and other features of the present invention will become more apparent from the following detailed description of the preferred embodiments of the present invention, when viewed in conjunction with the accompanying drawings.

DETAILED DESCRIPTION OF THE PREFERRED EMBODIMENT

Figure 1:
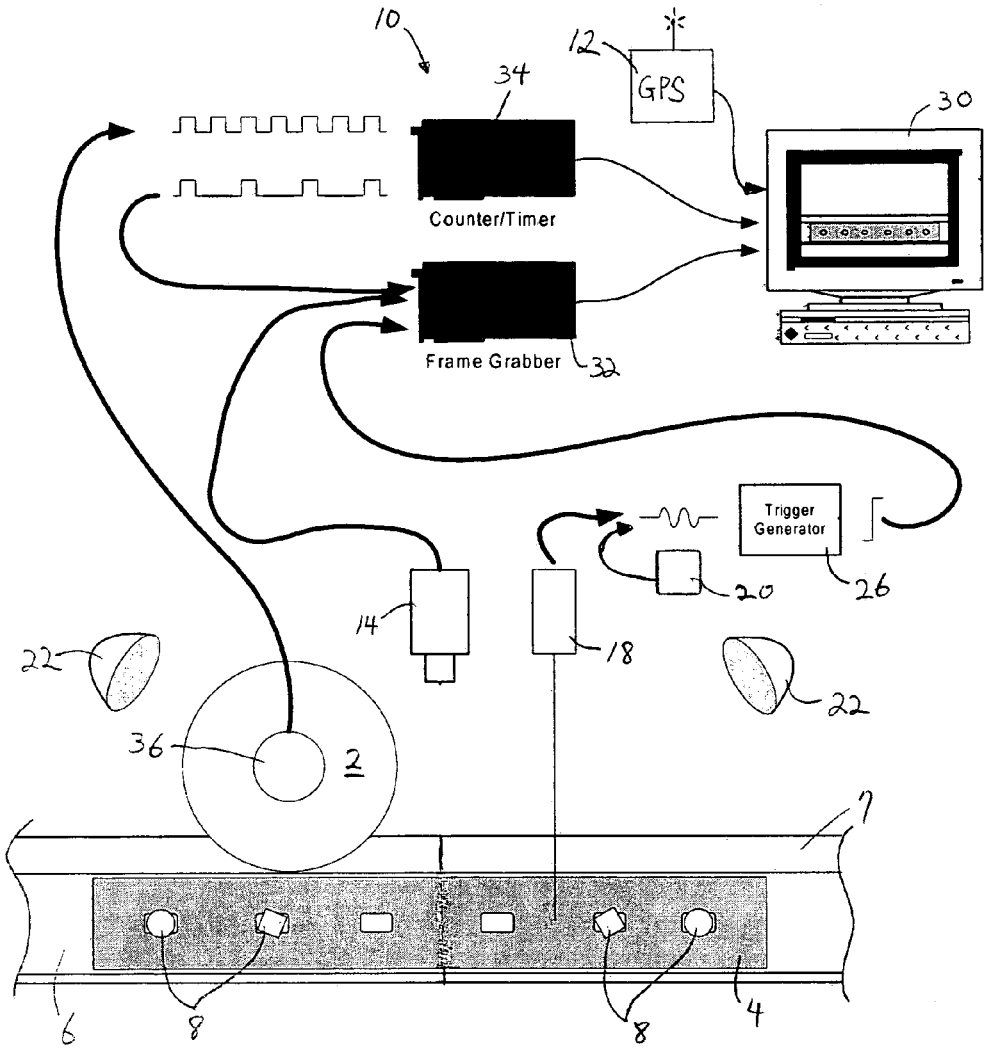
FIG. 1 shows a schematic illustration of a video inspection system in accordance with one embodiment of the present invention.

FIG. 1 shows an illustration of a video inspection system 10 in accordance with one example embodiment of the present invention that facilitates inspection of rail components while traveling on the railroad track. In particular, as will be evident from the discussion below, the video inspection system 10 facilitates inspection of rail components such as joint bars, switch frogs, rail fasteners, switch points, and rails themselves.

In the schematic example of FIG. 1, the inspected rail component is a joint bar 4 that secures the sides (i.e. webs) of two rails 6 and 7 of a railroad track together via fasteners 8. As can be appreciated, only one side of the railroad track is shown in FIG. 1. As will be discussed below, the video inspection system 10 utilizes digital video, computer imaging, and illumination technologies to allow accurate, and efficient inspection of rail components, with reduced time and effort as compared to conventional methods of inspection. It should be initially noted that whereas the present invention is described in detail below as inspecting joint bars 4 due to their importance in causing derailments, the present invention is not limited thereto, and may be utilized for inspection of any rail component that can appropriately be inspected using the video inspection system 10.

As shown in FIG. 1, the video inspection system 10 of the illustrated embodiment includes a high-resolution camera 14, a distance sensor 18 for detecting the presence of a rail component, an optional vibration sensor 20, and one or more light sources 22. These components are located under a railcar or a vehicle such as a hi-railer that is adapted to travel on the rails 6 and 7 of the railroad track. It should be noted that FIG. 1 merely shows a schematic illustration of the video inspection system 10. Thus, the relative positioning of the various components of the video inspection system 10 is shown merely to facilitate understanding, and need not represent the actual relative positioning of these components.

In addition to the components that are located under the railcar or vehicle, the video inspection system 10 also includes a trigger generator 26, and a computer 30 with a camera interface device 32 and a counter/timer device 34. It should be noted that whereas in the schematic illustration of FIG. 1, the interface device 32 and counter/timer device 34 are shown as being separate from the computer 30, these devices are preferably housed in the computer 30 and connected to the bus of the computer 30. In addition, although the interface device 32 and the counter/timer device 34 are shown as being implemented as boards, these devices may be implemented differently in other embodiments. Furthermore, the interface device 32 and the counter/timer device 34 may be implemented as a single integrated board. However, these devices are discussed as being implemented separately herein to more clearly describe their respective functions.

The computer 30 of the illustrated embodiment has a processor and memory (not shown), for processing and storing data and instructions associated with the control and function of the interface device 32 and the counter/timer device 34, and to further store the images of the rail components. In addition, the computer 30 is also preferably provided with digital image processing software and/or hardware that are adapted to process the images of the rail components that have been captured. The digital image processing software/hardware may be any appropriate software/hardware that allows performance of image processing as described in further detail below. If implemented as software, the software can be stored in the memory as well.

Furthermore, the video inspection system 10 of the illustrated embodiment is also provided with an encoder 36 that is adapted to measure the rotation of a wheel 2 of the vehicle or railcar, the wheel riding on the rails 6 and 7 of the railroad track. Moreover, the video inspection system 10 shown also includes a Global Positioning System (GPS) receiver 12 that allows determination and monitoring of the position of the vehicle or railcar on which the video inspection system 10 is implemented. These components of the video inspection system 10 are provided on the vehicle or railcar that rides on the rails 6 and 7, and thus, can be utilized to inspect the rail components while traveling on the railroad track. The details of these various components of the video inspection system 10 and their operation are further discussed below.

Figure 2:
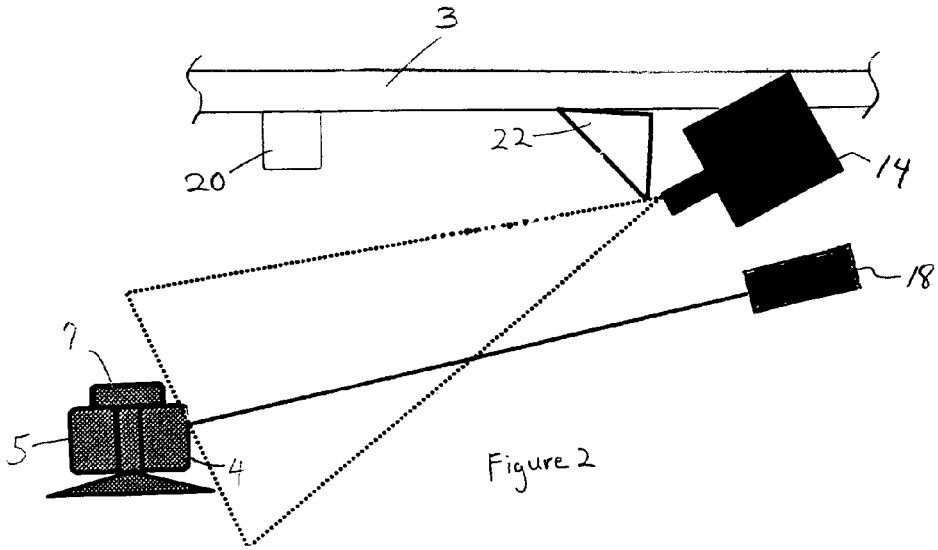
FIG. 2 shows an example arrangement of various components of the video inspection system.

FIG. 2 shows an example schematic arrangement of various components which are mounted on a frame member 3 of the vehicle or railcar for which the video inspection system 10 is implemented (only a small portion being shown). In this regard, the camera 14, distance sensor 18, vibration sensor 20 and light source 22, may be secured to the frame member 3 or other component of the vehicle or railcar in any appropriate manner using brackets, fasteners and/or other securing hardware. FIG. 2 shows a cross sectional view of the rail 6 (extending into, and out of the page) with the light source 22, camera 14, and the distance sensor 18, these components being positioned at a slight angle and elevated relative to the rail 6 of the railroad track. The vibration sensor 20 need not be positioned proximate to the camera 14, the distance sensor 18, or the light source 22, but is preferably located on the frame member 3 proximate to the wheel 2.

As explained in detail below, the distance sensor 18 detects the presence of a joint bar 4 so that the images of the rail components that are provided by the camera 14 can be captured by the video inspection system 10. In this regard, sufficient illumination is provided by the light source 22 to allow capturing of images that show the rail components in sufficient detail to allow inspection of the rail components. It should be noted that the rail 7 of the railroad track may also be provided with another joint bar 5 on the other side of the rail 7 as shown in FIG. 2. To allow inspection of this joint bar 5 or other rail components, another set of video components, including the light source 22, camera 14, and distance sensor 18, may be provided in a similar manner on the other side of the rail 7, so as to allow video inspection of the joint bar 5 or other rail components. Moreover, it should be noted that railroad tracks typically have two parallel rails. Thus, an additional pair of video components such as the light source, camera, and distance sensor may be provided to capture images of the parallel rail (not shown). Of course, these components may be mounted to any appropriate structure in any appropriate manner.

It should be appreciated that the development of the video inspection system 10 for inspection of rail components from a fast moving vehicle or railcar is difficult for a variety of reasons. The first difficulty resides in reliably detecting approaching rail components, such as joint bars, in order to capture their video images at the right time. The second difficulty resides in providing good quality, high-resolution, digital images that clearly show small surface cracks that may be present on the rail components, such cracks frequently being only about one millimeter in width. When the rail components are very close to the camera 14, and are moving rapidly in the camera's field of view, the acquired image of the rail components become smeared. This smearing effect can be overcome by utilizing a very short exposure time. However, this requires a high sensitivity camera and/or very intensive illumination. Another difficulty is that illumination should be uniform in order to minimize uneven image quality and shadows. At the same time, illumination should enhance the visibility of cracks and/or defects in the rail components.

In order to ensure that visual detection of cracks of approximately one millimeter is possible, the camera 14 of the video inspection system 10 should preferably achieve a resolution of ½ mm or better. To attain this, the camera 14 is preferably implemented with a line scan camera, and the light source 22 is adapted to provide a continuous illumination. Line scan cameras allow for extremely fast line rates, and can acquire images with a continuous light source. In this implementation of the present invention, the image of the sides of the rails 6 and 7 are provided by the camera 14, scan by scan, which are then assembled to provide a complete image. When the distance sensor 18 detects the joint bar 4, images of the rail and corresponding rail components are captured and stored in the computer 30 for display as shown.

An appropriate camera 14 for use in the video inspection system 10 is model Spyder SP-14 available from DALSA Corporation. The specification for this camera is available from the manufacturer's web site for DALSA Corporation. Briefly, the Spyder SP-14 is capable of line rates up to 67 kHz at 512 pixels per line, and runs on a 40 MHz pixel clock which is indicative of how quickly the data can be output to the computer 30 (one pixel being transferred per clock tick). The Spyder SP-14 allows for a maximum electronic gain of 8×, which means that the sensitivity of the sensor can be magnified by a factor of 8. Of course, the noted Spyder SP-14 camera is described merely as one example camera that may be used in the video inspection system 10, and other cameras may be used in practicing the present invention in other implementations.

In order to acquire the images that are provided by the camera 14, the camera 14 is electronically connected to the camera interface device 32, which may be implemented as a frame grabber. The camera interface device 32 captures the images provided by the camera 14 for storage in memory of the computer 30. As previously noted, the camera interface device 32 may be an add-on board that is connected to the bus of the computer 30. An appropriate camera interface device 32 for the video inspection system 10 is the frame grabber board model Road Runner PCI-RUN-11M available from BITFLOW. The specification for this camera is available from the manufacturer's web site for BITFLOW. Briefly, the Road Runner frame grabber board is compatible with most cameras that output a differential signal, and supports a camera with a pixel clock of up to 40 MHz. This device also has provisions for encoder and trigger inputs. Of course, the noted Road Runner PCI-RUN-11M frame grabber board is described as an example of an interface device that may be used in the video inspection system 10, and other interface devices may be used in practicing the present invention in other implementations.

In order to ensure accurate detection of the rail component such as the joint bar 4 shown in FIG. 1, the distance sensor 18 is implemented using a laser based distance sensor. It should be noted that many laser based distance transducers will not work reliably unless the laser beam is perpendicular to the surface being measured. This would mean that the distance sensor 18 would have to be mounted near the ground level since the joint bar 4 is positioned, and attached, to the sides of the rails 6 and 7. However, such positioning of the distance sensor 18 is not preferred since the distance sensor 18 can become damaged by objects such as rocks, or even damaged ties, that may be present between the rails of the railroad track.

In the above regard, an appropriate distance sensor 18 for the video inspection system 10 is the laser based LT3 time-of-flight sensor available from Banner Engineering Corp. The specification for this sensor is available from the manufacturer's web site for Banner Engineering Corp. Briefly, LT3 sensor works reliably at an angle of up to 20° so that the distance sensor 18 can be mounted higher than the railroad track. In addition, the offset and range of the LT3 sensor is user scalable to allow maximum resolution over the working area.

Referring again to FIG. 1, the distance sensor 18 is electronically connected to the trigger generator 26 of the video monitoring system 10. The trigger generator 26 is implemented to receive the signal from the distance sensor 18, and generate a trigger signal to the interface device 32 described above so that the interface device 32 captures the images provided by the camera 14 in response to the trigger signal. In other words, the distance sensor 18 provides a signal to the trigger generator 26 when the distance sensor 18 detects the joint bar 4, or other rail component, and the trigger generator 26 provides a trigger signal to the interface device 32 which captures the image provided by the camera 14.

Figure 3:
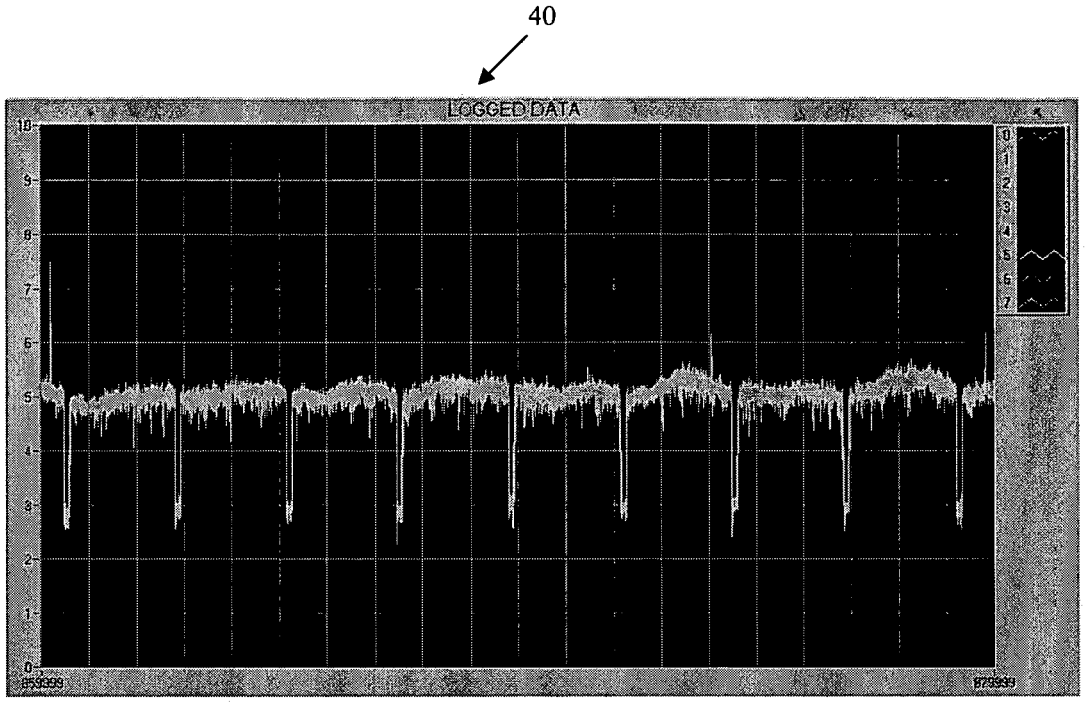
FIG. 3 shows the output signal of a distance sensor used in one implementation of the video inspection system.
Figure 4:
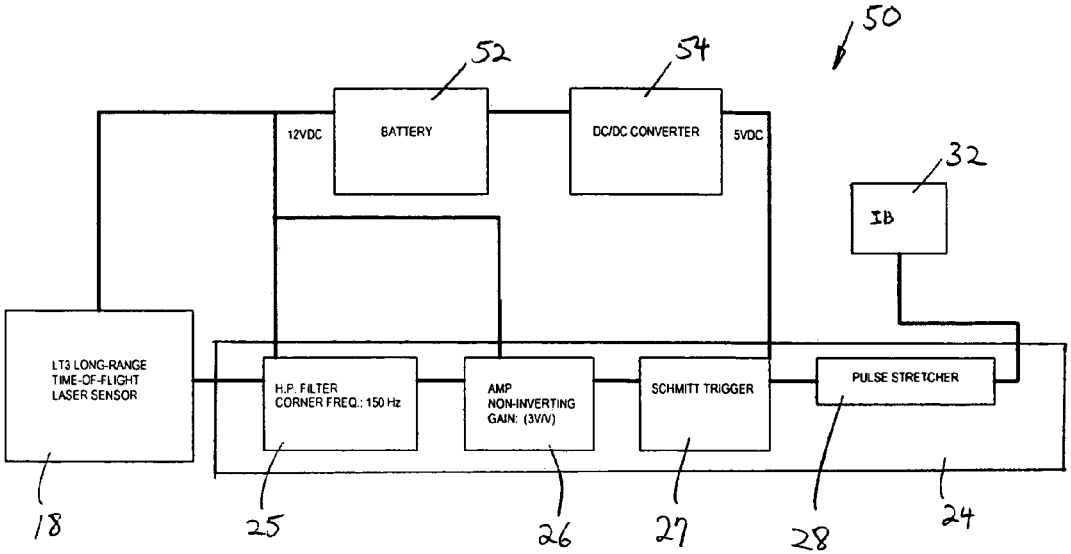
FIG. 4 shows a schematic illustration of the interface between the distance sensor and the trigger generator in accordance with one example implementation.

FIG. 3 shows graph 40 which illustrates a portion of the raw output voltage signal of the LT3 time-of-flight sensor discussed above. Each of the valleys shown in the graph 40 represent detection of a joint bar. This output signal is received by the trigger generator 26 to generate a trigger signal which is provided to the interface device 32 as described. In this regard, FIG. 4 shows a schematic illustration of the interface circuit 50, the distance sensor 18, and the trigger generator 26, in accordance with one example implementation of the present invention. As shown, a battery 52 and DC/DC converter 54 are provided to supply appropriate electrical power to the distance sensor 18 and the trigger generator 26 schematically shown.

The trigger generator 26 shown is designed to generate a trigger signal in response to the distance sensor's 18 detection of an abrupt change in the sensed distance. For example, the trigger generator 26 generates a trigger signal when a joint bar 4 suddenly enters into the sensing field of the distance sensor 18, but does not generate a trigger signal in response to relatively slow changes in distance that may be caused by side-to-side movement of the vehicle or railcar as it travels on the railroad track. The trigger generator 26 in the illustrated implementation receives the raw, single-ended analog voltage signal, such as that shown in graph 40 of FIG. 3, directly from the distance sensor 18. The distance sensor 18 outputs an analog voltage signal directly, or inversely, proportional to the distance of the sensor to the rails 6 and 7, depending on its configuration.

Referring again to FIG. 4, the trigger generator 26 allows differentiation of side to side movement of the truck from the presence of joint bar 4 or other rail component. In this regard, the raw analog voltage signal received from the distance sensor 18 is passed through a filter such as a High-Pass Butterworth filter 25, which in the illustrated embodiment, is implemented with a corner frequency of 150 Hz. The filtered signal is then amplified via amplifier 24, and passed through a Schmitt trigger 27 which converts the analog signal indicating presence of joint bar 4, to a digital signal, for example, into TTL (transistor-transistor logic) pulses. For timing purposes, the TTL pulses provided by the Schmitt trigger 27 may be stretched by a pulse stretcher 28. In the present example, the TTL pulses may be stretched to a pulse width of 100 ms by the pulse stretcher 28. Such a pulse width is sufficient for the interface device 32 to acknowledge the presence of the joint bar 4, and to capture the image provided by the camera 14. Of course, the above described implementation of the trigger generator 26 and the interface circuit 50 shown are merely provided as an example embodiment in which the distance sensor 18 is implemented with the distance sensor noted. In other embodiments, the interface circuit and the trigger generator may be implemented in any appropriate manner to properly interface with the specific model of the distance sensor 18 used.

Referring again to FIG. 1, the video inspection system 10 in accordance with the illustrated embodiment includes an optional vibration sensor 20. As previously described, the vibration sensor 20 is preferably secured to a frame member that is proximate to a wheel of the vehicle or railcar on which the video inspection system 10 is provided. The vibration sensor 20 may be one or more accelerometers that are adapted to sense vibration experienced by the frame member, including abnormal/atypical vibration. In particular, the vibration sensor 20 senses the vibration caused by the rails as the wheels of the vehicle or railcar rolls along the rails. This vibration is passed through the suspension/axle components to the frame member to which the vibration sensor 20 is secured so that the vibration is sensed by the vibration sensor 20. The vibration sensor 20 outputs a vibration signal that is provided to the trigger generator 26 of the video inspection system 10 so that when an atypical/abnormal vibration is sensed, the video inspection system 10 captures the image of the rail and rail components.

More specifically, when there is a defect or damage to the rail or rail component, the vibration sensed by the vibration sensor 20 may be atypical/abnormal. For example, if the two adjoining rails have become separated by a gap that exceeds an acceptable tolerance level, the vibration sensed may be severe and the output signal may show a sharp impact peak as the wheel of the vehicle or railcar travels over the gap. This output signal is provided to the trigger generator 26 that generates a trigger signal, and provides the signal to the interface device 32. The images of the rail and the rail components is captured in the manner previously described based on the trigger signal. This allows inspection of the rail and rail components so that the source or cause of the atypical/abnormal vibration can be investigated by visual inspection. Of course, appropriate signal conditioning components such as amplifiers and/or filters may be provided between the vibration sensor 20 and the trigger generator 26 to allow the trigger generator 26 to receive the output signal and generate the appropriate trigger signal.

Figure 5:
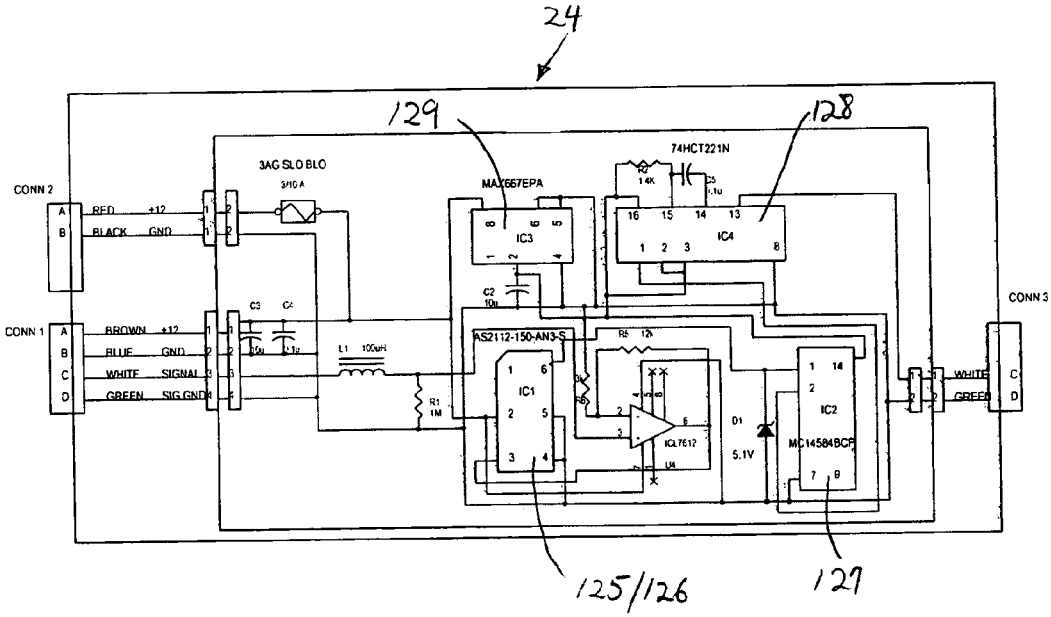
FIG. 5 shows a detailed schematic illustration of a trigger generator in accordance with one example implementation.

FIG. 5 shows a detailed schematic illustration of a trigger generator 26 in accordance with one example that may be utilized in implementing the video inspection system. Although a specific circuit is shown, it should be evident that the present invention is not limited thereto. The trigger generator 26 is provided with an integrated circuit 125/126 which functions as a High-Pass Butterworth filter 25, and amplifier 24 that provides an inverting gain. The integrated circuit 127 functions as a Schmitt trigger 27 to convert analog signals indicating presence of joint bar 4 to a digital signal, while the integrated circuit 128 functions as the pulse stretcher 28. Various other components and electrical connections between the components are provided in the present implementation of the trigger generator 26, for example, the integrated circuit 129 which functions as a voltage regulator.

Referring again to FIG. 1, the video inspection system 10 of the illustrated embodiment is provided with an encoder 36 that is electrically connected to the counter/timer 34, which in turn, is electrically connected to the interface device 32. The encoder 36 is adapted to detect the rotation of the wheel 2 as the vehicle or railcar travels on the railroad track. The encoder 36 may be implemented as an optical encoder, and functions as a tachometer for the video inspection system 10. For example, the encoder 36 of the illustrated embodiment provides a pulse to the counter/timer device 34 for every 0.5 millimeter of linear distance traveled by the wheel 2 of the vehicle or railcar on which the video inspection system 10 is implemented.

Like the interface device 32, the counter/timer device 34 may be an add-on board that is connected to the bus of the computer 30. As previously noted, the counter/timer device 34 may alternatively be integrated together with the interface device 32. The pulses provided by the encoder 36 are processed by the counter/timer device 34 into a corresponding signal that is provided to the interface device 32 to thereby allow the interface device 32 to capture constant resolution images from the camera 14, independent of speed of the vehicle or railcar.

Referring again to FIG. 1, the video images obtained using the camera 14, the distance sensor 18, light source 22, trigger generator 26, and the interface device 32, as described above, are preferably correlated to the position data of the vehicle or railcar on which the video inspection system 10 of the present invention is implemented. In this regard, a positioning means may be provided so that location of the rail component can be located if a defect in the rail component is found by inspection of the captured images. This correlated information can be stored in the computer system 30, and retrieved for inspection, so that appropriate repairs or maintenance can be scheduled and performed. Such positional data may be obtained in any appropriate manner by the positioning means, for example, the optional GPS receiver 12 shown in FIG. 1. Of course, other positioning means may be used instead, or together with, the GPS receiver 12. For example, such position data may be obtained by monitoring the distance traveled along the railroad track from a known starting point, or by monitoring the velocity and time from a known starting point.

The video inspection system 10 in accordance with the above described embodiment was implemented and its performance was tested in several phases. The first phase of the testing was designed to evaluate the suitability of the LT3 time-of-flight sensor as the distance sensor 18 for detecting a joint bar. The laser based distance sensor was mounted beneath a rail vehicle, and the raw output voltage signal of the distance sensor was collected while traveling on the railroad track. Graph 40 of FIG. 3 discussed previously above shows a small portion of the collected data. As previously noted in discussing graph 40, the signature of the output signal is quite distinct when the joint bars are detected, as indicated by the substantially periodic valleys shown.

The second phase of testing was performed on Amtrak's Automated Track Inspection Vehicle (ATIV). The camera and the distance sensor were mounted to the truck of the vehicle above the primary suspension. In addition, two 75 watt spotlights, each capable of two million candlepower, were also mounted to the truck frame. A 25 millimeter lens was used on the camera, and lighting at the desired location was measured to be between 18,000 and 22,000 lux (sunlight having a range of 100,000 to 130,000 lux). The distance sensor was mounted approximately 6 inches ahead of the location where the camera was pointed so that it will be unaffected by the lighting during testing. Of course, other appropriate specifications and mountings may be used in other implementations of the video inspection system of the present invention.

A field test was conducted on welded rails near the Amtrak maintenance facility over a section of a railroad track approximately 2 to 3 miles long at speeds of up to 30 miles per hour. Favorable results were obtained confirming the ability of the video inspection system of the present invention in allowing inspection of rail components while traveling on the railroad track. In particular, images of joint bars were captured as well as images of a switch frogs, rail fasteners, and rails themselves, thereby allowing inspection of such components.

More specifically, with the available lighting conditions, the exposure time of the camera was set to 15 μs. This indicates that to achieve a recording speed of 80 MPH, roughly twice the amount of lighting would be required. In addition, the actual resolution of the recorded images was found to be approximately 0.3 mm instead of the initially desired resolution of 0.5 mm. However, locating the camera slightly further away from the rail or using a lens with a slightly shorter focal length would adjust the resolution accordingly. The quality of the captured images was good, the images illustrating that a surface crack of about 1 mm in width should be visually detectable. Lighting was found to be adequate, but may be adjusted to give a more uniform illumination.

Figure 6A:
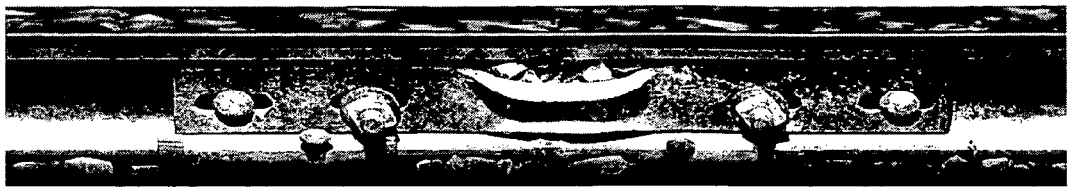
FIG. 6A shows a sample image of a joint bar that was captured during testing of the video inspection system in accordance with one implementation of the present invention.
Figure 6B:
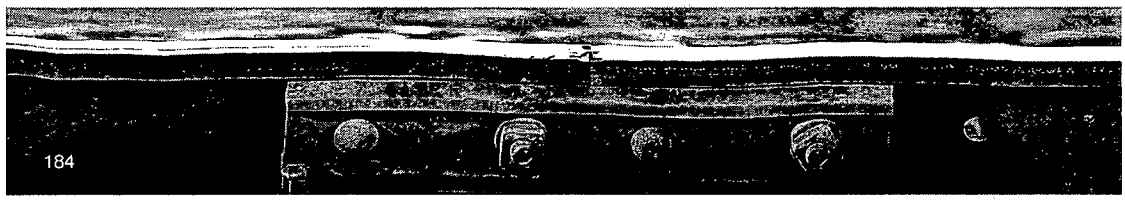
FIG. 6B shows another sample image of a different joint bar that was captured during testing.
Figure 6C:
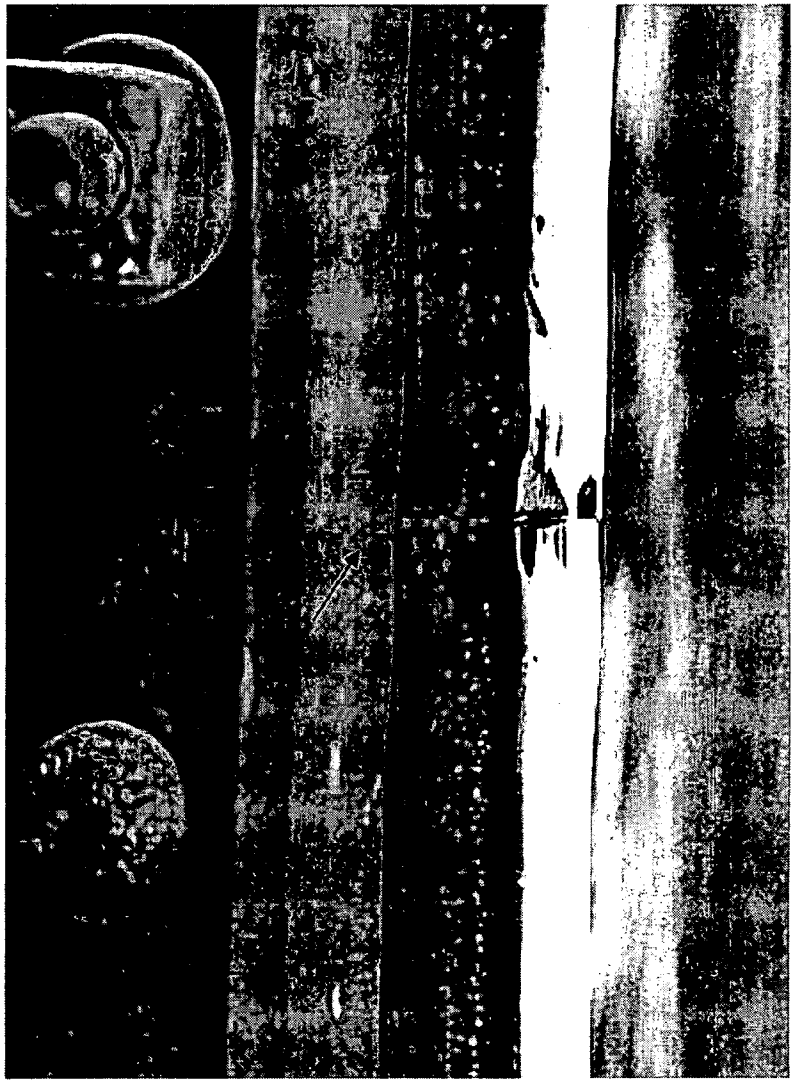
FIG. 6C shows an enlarged image of the joint bar shown in FIG. 6B.

FIGS. 6A to 6C show sample images of joint bars that were captured during testing of the video inspection system of the present invention. It should be noted that the image shown are scaled down to properly fit on paper, and therefore, does not show the full resolution of the actual digital images captured by the video inspection system of the present invention. In the present examples shown in FIGS. 6A to 6C, all of the images were saved in the computer in JPG format with a quality setting of 90% resulting in file sizes of approximately 300 kb. Of course, other formats may be used in other embodiments. FIG. 6C shows an enlarged image of the joint bar shown in FIG. 6B. A small surface crack is clearly visible as indicated by the arrow. Such captured images can be inspected for defects and/or damage using the video inspection system of the present invention, and the captured images can be stored and retrieved to facilitate repair.

During the final phases of testing, it became apparent that the Spyder SP-14 camera utilized in the implementation of the present invention described above limits the image capture speed to approximately 50 MPH due to the resolution and speed requirements, and the manner in which the camera operates. Of course, it may be desirable to increase this speed limitation in order to allow more rapid inspection of the railroad track, or even allow implementation of the video inspection system on an actual railcar that is in service. For example, an Amtrak passenger car often exceeds 60 MPH in its travel route. Thus, in such applications, different camera may be utilized to increase the speed capacity. For example, camera model Phiranha 2, also available through DALSA Corporation, would allow the video inspection system of the present invention to capture images of rail and rail components while the vehicle or railcar is traveling at a speed of approximately 80 MPH.

It should be understood that whereas the above embodiment of the video inspection system was described using components based on specific technologies, the present invention is not limited thereto, and may be implemented using components that are based on alternative technologies. For example, whereas the above described embodiment utilized a line scan camera with a continuous light source, one disadvantage of line scan cameras is that they have a proprietary digital interface which increases the cost of software development. Thus, in other embodiments, a high resolution, high sensitivity area scan camera may be used together with high-powered strobe lights. In such an approach, both the camera and the strobe lights may be triggered when the distance sensor detects a rail component. Most area scan cameras have a standard analog output, which makes image acquisition relatively simple. In order to freeze the images without blur, extremely short exposure times such as 7 μs, or less are needed, which can be achieved by using a high intensity strobe light.

In still other embodiments, a time delay integration (TDI) line scan camera may be utilized. While a TDI line scan camera requires much less light to acquire an image, it may not allow control over exposure that is independent of line rate, such a feature being desirable for maintaining a constant exposure level for varying speeds. In addition, such TDI line scan cameras are more costly than conventional line scan cameras. Thus, although other technologies may be used in practicing the present invention, use of a conventional line scan cameras have been found to be especially suitable.

As noted, the computer 30 of the illustrated embodiment is implemented with digital image processing software and/or hardware for facilitating analysis of the images of the rail components that have been captured and stored. For example, the digital image processing software/hardware may be implemented to allow zooming and panning of the captured images. In addition, the digital image processing software/hardware may include pattern recognition software to allow automated identification of defects or damage to the rail components that are captured in the stored images, and to further flag such images. This allows retrieval of the images with the defective or damaged rail components, together with the correlated location information, so that appropriate service can be scheduled and performed. As noted, the digital image processing software/hardware may be any appropriate hardware/software for performing the functions described. Use of the described pattern recognition software minimizes the need for an individual inspector to actually inspect each of the captured images of the rail components. Instead, the inspector can inspect those images that have been flagged by the video inspection system 10 as showing a rail component with a defect or damage thereto.

Of course, the implementation and operation of the video inspection system 10 described in detail above are merely examples and the present invention is not limited thereto. For example, the digital image processing software/hardware implemented with pattern recognition software may be utilized to continually analyze the stream of video images provided by the camera 14, and to provide an appropriate trigger signal to capture images of rail components based on the analysis. In particular, when a pattern indicative of damage or defect to a rail component is recognized by the digital image processing software/hardware, the interface device 32 may be provided with a trigger signal to capture and store the image in the computer 30, the captured image showing the damaged or defective rail component. The trigger signal may be provided by the digital image processing software/hardware to the interface device 32 directly using the bus of computer 30, or via the trigger generator 26. Thus, in the above described operation, the digital image processing software/hardware acts to trigger the capturing of the image of the damaged or defective rail component that is provided by the camera 14. This implementation and operation of the video inspection system 10 is especially advantageous in that the surface condition of the rail itself on which the railcar or vehicle travels can also be monitored. In particular, rail surface conditions such as corrugation and/or shelling can be monitored by analyzing the image of the rail surface that is provided by the camera 14.

As can be appreciated, the above described operation of the video inspection system 10 using the digital image processing software/hardware also greatly expedites inspection of rail components so that the inspector needs to only carefully inspect the captured images of rail components that have been identified as having defects or damage. Moreover, because the captured images are correlated with the position data provided by the GPS receiver 12, for example, the location of the defective or damaged rail components can be determined and provided to the user so that these rail components can be appropriately serviced.

Furthermore, in accordance with still another implementation, the digital image processing software may be implemented with optical character recognition software to recognize inscriptions on the rails of the railroad track. In particular, rails used in railroad tracks are generally branded with inscriptions that typically identify the manufacturer of the rail, the date of manufacture, as well as other information. Thus, the images of these inscriptions may be captured, stored and analyzed to determine whether service or replacement of the rails is necessary. For example, if the rails analyzed are determined to have been in service beyond their useful service life, or are from a manufacturer whose rails are known to have specific defects or failure modes, the rails can be scheduled for replacement.

In accordance with yet another embodiment, the video inspection system 10 may be operated so that a continuous video stream of images of the railroad track is recorded instead of still frame images as described above. In such an embodiment, the distance sensor 18 or the trigger generator 26 need not be used since triggering is not necessary. Instead, the camera 14 provides a continuous video stream of images of the rail components that are illuminated via light source 22, and the video images are stored into the memory of the computer 30. The continuous video stream of images may be then be retrieved and played back at a slower rate or even paused to allow inspection of the railroad components. However, such use of the video inspection system 10 does not provide the advantage of significantly expediting inspection of the railroad track.

Thus, in the above described operation of the video inspection system 10 where continuous video stream of images of the railroad track is stored, the digital image processing software/hardware with the pattern recognition software may be used in post processing analysis to automatically identify the rail components having defects or damage. In this regard, the digital image processing software/hardware may be further adapted to display a segment of the stored image that most clearly shows the damage or defects as determined by the pattern recognition software, as well as the locations of these damaged or defective rail components.

It should also be noted that the various implementations and operation of the video inspection system 10 as described above may be used independently, or in combination with each other. In addition, the implementations may be used in conjunction with visual enhancement techniques for enhancing the visibility of defects or damage to the rail components. For example, a dye which penetrates into cracks to enhance their visibility, may be sprayed onto the railroad track before the image thereof is captured by the video inspection system 10.

In view of the above, it should also be evident to one of ordinary skill in the art that another aspect of the present invention is providing a method for inspecting rail components of a railroad track while traveling on the railroad track. In one embodiment, the method includes the steps of illuminating a rail of the railroad track, electronically detecting the presence of a rail component, providing an output signal indicating presence of the rail component, providing a camera adapted to provide an image of the rail component, and capturing the image of the rail component that is provided by the camera based on the output signal.

In accordance with another embodiment, the method for inspecting rail components includes the steps of illuminating a rail of the railroad track, electronically detecting vibration caused by the rail of the railroad track while traveling thereon, providing an output signal indicating atypical or abnormal vibration, providing a camera adapted to provide an image of a rail component and capturing the image of the rail component that is provided by the camera based on the output signal.

In accordance with still another embodiment of the present invention, the method for inspecting rail components includes the steps of illuminating a rail of the railroad track, automatically providing a trigger signal, providing a camera adapted to provide an image of the rail component, and capturing the image of the rail component that is provided by the camera based on the trigger signal. In one implementation, the method may further include the step of electronically detecting the presence of the rail component, wherein the trigger signal is automatically provided when the rail component is detected. In another implementation, the method further includes the step of electronically detecting vibration caused by the rail of the railroad track while traveling thereon, the trigger signal being automatically provided when an atypical or abnormal vibration is detected. Finally, in yet another implementation, the method further includes the step of digitally processing the captured image to identify at least one of defect and damage to the rail component, the trigger signal being automatically provided upon identification of a defect or damage to the rail component.

Therefore, in view of the above, it should now be evident to one of ordinary skill in the art, how the present invention provides a system and method that allows inspection of joint bars and other rail components while traveling on the railroad track. It should be also evident that the video inspection system and method of the present invention allows accurate and efficient inspection of rail components, with reduced time and effort, when compared to conventional methods of inspection.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

The invention claimed is:

1. A video inspection system mountable on a railcar or a vehicle adapted to travel on a railroad track, said railroad track including individual rails, said video inspection system being adapted to facilitate inspection of predetermined rail components while traveling on the railroad track, said video inspection system comprising:

a light source adapted to provide illumination to at least one rail of the railroad track to illuminate visible surfaces of the predetermined rail components on upper and/or side surfaces of the rail;

a sensor adapted to provide an output signal upon detection of the predetermined rail components indicative of the presence of the predetermined rail components;

a camera adapted to provide an image of each predetermined rail component detected by said sensor;

a trigger generator adapted to convert said output signal from said sensor to a trigger signal, wherein the trigger generator is activated upon detection of each predetermined rail component; and a computing device adapted to capture and store said image of each predetermined rail component provided by said camera and to compare each predetermined rail component to a pattern indicative of damage or a defect in each predetermined rail component.

2. The video inspection system of claim 1, wherein said computing device further includes an interface device that captures said image provided by said camera based on said trigger signal.

3. The video inspection system of claim 1, further comprising an encoder that provides pulse signals corresponding to a speed of the vehicle or railcar.

4. The video inspection system of claim 3, wherein said computing device further includes a counter/timer device that allows capturing of constant resolution images from said camera, independent of the speed of the vehicle or railcar.

5. The video inspection system of claim 1, further comprising a positioning means for determining the position of the railcar or the vehicle, and for providing position data indicative of said determined position.

6. The video inspection system of claim 5, wherein said computing device is further adapted to correlate said captured image of each predetermined rail component with said position data to allow determination of the location at which said image was captured.

7. The video inspection system of claim 5, wherein said positioning means includes a GPS receiver.

8. The video inspection system of claim 1, wherein said sensor is a distance sensor, and said output signal from said sensor is indicative of the presence of each predetermined rail component.

9. The video inspection system of claim 8, wherein said distance sensor is a laser based sensor positioned above, and pointed towards, the rail of the railroad track.

10. The video inspection system of claim 1, wherein said sensor is a vibration sensor, and said output signal from said sensor is indicative of the presence of each predetermined rail component.

11. The video inspection system of claim 10, wherein said vibration sensor is at least one accelerometer secured to a frame member of the railcar or the vehicle.

12. The video inspection system of claim 1, wherein said camera is a line scan camera and said light source provides continuous illumination.

13. The video inspection system of claim 1, wherein said camera is an area scan camera and said light source is a strobe light that provides flash illumination.

14. The video inspection system of claim 1, wherein said computing device includes a digital image processing software for analyzing said captured images.

15. The video inspection system of claim 14, wherein said digital image processing software includes a pattern recognition software for identifying presence of a defect or damage to each predetermined rail component.

16. A video inspection system mountable on a railcar and/or a vehicle adapted to travel on a railroad track, said railroad track including individual rails, said video inspection system being adapted to facilitate inspection of predetermined rail components while traveling on the railroad track, said video inspection system comprising:

a light source adapted to provide illumination to at least one rail of the railroad track to illuminate visible surfaces of the predetermined rail components on upper and/or side surfaces of the rail;

a distance sensor that is pointed toward the rail of the railroad track, said distance sensor being adapted to provide an output signal indicating the presence of each predetermined rail component upon detection of said predetermined rail components;

a trigger generator adapted to convert said output signal from said distance sensor to a trigger signal, wherein the trigger generator is activated upon detection of each predetermined rail component;

a camera adapted to provide an image of each predetermined rail component;

a computing device adapted to capture and store said image of each predetermined rail component provided by said camera and to compare each predetermined rail component to a pattern indicative of damage or a defect in the rail component, said computing device including a memory device for storing said captured image to allow retrieval of said stored image; and a position means for determining the position of the railcar or the vehicle, and for providing position data indicative of said determined position;

wherein said computing device is further adapted to correlate said captured image of each predetermined rail component with said position data to allow determination of the location at which said image was captured.

17. The video inspection system of claim 16, wherein said distance sensor is a laser based distance sensor.

18. The video inspection system of claim 16, further comprising a trigger generator for converting said output signal from said distance sensor to a trigger signal, and wherein said computing device includes an interface device adapted to capture said image provided by said camera based on said trigger signal.

19. The video inspection system of claim 16, wherein said computing device includes a digital image processing software with a pattern recognition software for identifying presence of a defect or damage to each predetermined rail component.

20. A method for inspecting predetermined rail components of a railroad track, said railroad track including individual rails, while traveling on the railroad track comprising the steps of:

illuminating at least one rail of the railroad track to illuminate visible surfaces of the predetermined rail components on upper and/or side surfaces of the rail;

providing a camera adapted to provide an image of each predetermined rail component;

detecting the presence of said predetermined rail component using a sensor;

providing an output signal indicating the presence of each predetermined rail component;

converting the output signal to a trigger signal with a trigger generator, wherein the trigger generator is activated upon detection of each predetermined rail component; and capturing and storing said image of each predetermined rail component that is provided by said camera and comparing each predetermined rail component to a pattern indicative of damage or a defect in each predetermined rail component.

21. The method of claim 20, further including the step of determining the position at which said image was captured and correlating said captured image of each predetermined rail component with said determined position.

22. The method of claim 20, further including the step of digitally processing said captured image to identify at least one of defect and damage to each predetermined rail component.

23. A method for inspecting predetermined rail components of a railroad track, said railroad track including individual rails, while traveling on the railroad track comprising the steps of:

illuminating at least one rail of the railroad track to illuminate visible surfaces of the predetermined rail components on upper and/or side surfaces of the rail;

detecting the presence of the predetermined rail components based on the signature of the output of a vibration sensor to provide an output signal indicative of the presence of the redetermined rail components;

providing a camera adapted to provide an image of each predetermined rail component;

converting the output signal to a trigger signal with a trigger generator, wherein the trigger generator is activated upon detection of each predetermined rail component; and capturing and storing said image of each predetermined rail component that is provided by said camera and comparing each predetermined rail component to a pattern indicative of damage or a defect based on said trigger signal.

24. The method of claim 23, further including the step of determining the position at which said image was captured.

25. The method of claim 24, further including the step of correlating said captured image of each predetermined rail component with said determined position.

26. The method of claim 23, further including the step of digitally processing said captured image to identify at least one of defect and damage to each predetermined rail component.

27. The video inspection system of claim 1, wherein said sensor is a camera adapted to collect images of the rail and each predetermined rail components, and the predetermined rail components are identified by pattern recognition algorithms of the images.

28. The video inspection system of claim 27, wherein said camera sensor is the same camera used in image acquisition of the rail and the predetermined rail components.

29. The video inspection system of claim 14, wherein said digital image processing software includes a pattern recognition software for identifying presence of a defect in, damage to, or anomaly of each predetermined rail component.

30. The method of claim 20, further including the identification of each predetermined rail component by evaluating the signature output of a distance sensor(s), where said distance sensor(s) is a laser.

31. The method of claim 20, further including the identification of each predetermined rail component by evaluating the signature output of a vibration(s) sensor.

32. The method of claim 20, further including the identification of each predetermined rail component by applying pattern recognition software to images acquired of the rail and the predetermined rail components by said camera.

33. A video inspection system mountable on at least one of a railcar or a vehicle adapted to travel on a railroad track, said railroad track including individual rails, said video inspection system being adapted to facilitate inspection of a predetermined rail components while traveling on the railroad track, said video inspection system comprising:

a light source adapted to provide illumination to at least one rail of the railroad track to illuminate visible surfaces of the predetermined rail components on upper and/or side surfaces of the rail;

a vibration sensor that is mounted on the railcar and/or vehicle, said vibration sensor being adapted to provide an output signal indicating the presence of each predetermined rail component upon detection of said predetermined rail component;

a trigger generator adapted to convert said output signal from said vibration sensor to a trigger signal, wherein the trigger generator is activated upon detection of each predetermined rail component;

a camera adapted to provide an image of each predetermined rail component based on the trigger signal;

a computing device adapted to capture and store said image of each predetermined rail component provided by said camera and to compare each predetermined rail component to a pattern indicative of damage or a defect in each predetermined rail component based on said trigger signal from said distance sensor, said computing device including a memory device for storing said captured image to allow retrieval of said stored image; and a position means for determining the position of the railcar and/or the vehicle, and for providing position data indicative of said determined position;

wherein said computing device is further adapted to correlate said captured image of each predetermined rail component with said position data to allow determination of the location at which said image was captured.

34. The video inspection system of claim 33, wherein said vibration sensor is an accelerometer.

35. The video inspection system of claim 33, further comprising a trigger generator for converting said output signal from said vibration sensor to a trigger signal, and wherein said computing device includes an interface device adapted to capture said image provided by said camera based on said trigger signal.

36. The video inspection system of claim 33, wherein said computing device includes a digital image processing software with a pattern recognition software for identifying presence of a defect or damage to each predetermined rail component.

37. A video inspection system mountable on a railcar and/or a vehicle adapted to travel on a railroad track, said railroad track including individual rails, said video inspection system being adapted to facilitate inspection of predetermined rail components while traveling on the railroad track, said video inspection system comprising:

a light source adapted to provide illumination to at least one rail of the railroad track to illuminate visible surfaces of the predetermined rail components on upper and/or side surfaces of the rail;

a camera sensor that is pointed toward at least one rail of the railroad track, said camera sensor being adapted to provide images to a pattern recognition software for the purpose of indicating the presence of each predetermined rail component upon detection of said predetermined rail component;

a pattern recognition software which produces a trigger signal, wherein the trigger generator is activated upon detection of each predetermined rail component;

a camera adapted to provide an image of each predetermined rail component based on the trigger signal;

a computing device adapted to capture and store said image of each predetermined rail component provided by said camera and to compare each predetermined rail component to a pattern indicative of damage or a defect in each predetermined rail component, said computing device including a memory device for storing said captured image to allow retrieval of said stored image; and a position means for determining the position of the railcar and/or the vehicle, and for providing position data indicative of said determined position;

wherein said computing device is further adapted to correlate said captured image of each predetermined rail component with said position data to allow determination of the location at which said image was captured.

38. The video inspection system of claim 37, wherein said camera sensor provides images to a pattern recognition software which determines the presence of each predetermined rail component.

39. The video inspection system of claim 37, wherein said computing device includes a digital image processing software with a pattern recognition software for identifying presence of a defect or damage to each predetermined rail component.

40. A method for inspecting predetermined rail components of a railroad track, said railroad track including individual rails, while traveling on the railroad track comprising the steps of:

illuminating at least one rail of the railroad track to illuminate visible surfaces of the predetermined rail components on upper and/or side surfaces of the rail;

detecting the presence of the predetermined rail components based on the signature of the output of a distance sensor to provide an output signal, where said distance sensor is a laser sensor;

providing a camera adapted to provide an image of each predetermined rail component;

converting the output signal to a trigger signal with a trigger generator, wherein the trigger generator is activated upon detection of each predetermined rail component; and capturing and storing said image of each predetermined rail component that is provided by said camera and comparing each predetermined rail component to a pattern indicative of damage or a defect based on said trigger signal.

41. The method of claim 40, further including the step of determining the position at which said image was captured relative to a railroad track location.

42. The method of claim 41, further including the step of correlating said captured image of each predetermined rail component with said determined position.

43. The method of claim 40, further including the step of digitally processing said captured image to identify at least one of defect and damage to each predetermined rail component.

44. A method for inspecting predetermined rail components of a railroad track, said railroad track including individual rails, while traveling on the railroad track comprising the steps of:

illuminating at least one rail of the railroad track to illuminate visible surfaces of the predetermined rail components on upper and/or side surfaces of the rail;

detecting the presence of the predetermined rail components using pattern recognition software applied to images acquired of the rail from a camera sensor;

providing a camera adapted to provide an image of each predetermined rail component;

capturing and storing said image of each predetermined rail component that is provided by said camera and comparing each predetermined rail component to a pattern indicative of damage or a defect based on said trigger signal.

45. The method of claim 44, further including the step of determining the position at which said image was captured relative to a railroad track location.

46. The method of claim 45, further including the step of correlating said captured image of each predetermined rail component with said determined position.

47. The method of claim 44, further including the step of digitally processing said captured image to identify at least one of defect and damage to each predetermined rail component.

48. The video inspection system of claim 1, wherein the predetermined rail component includes a joint bar, a switch frog, and a switch point.

49. The video inspection system of claim 16, wherein the predetermined rail component includes a joint bar, a switch frog, and a switch point.

50. The method of claim 20, wherein the predetermined rail component includes a joint bar, a switch frog, and a switch point.

51. The method of claim 23, wherein the predetermined rail component includes a joint bar, a switch frog, and a switch point.

52. The video inspection system of claim 33, wherein the predetermined rail component includes a joint bar, a switch frog, and a switch point.

53. The video inspection system of claim 37, wherein the predetermined rail component includes a joint bar, a switch frog, and a switch point.

54. The method claim 40, wherein the predetermined rail component includes a joint bar, a switch frog, and a switch point.

55. The method claim 44, wherein the predetermined rail component includes a joint bar, a switch frog, and a switch point.

* * * * *